United States Patent [19]

Gstettner et al.

[11] Patent Number: 4,747,225

[45] Date of Patent: May 31, 1988

[54] WEAPON BARREL WITH METALLORGICALLY BONDED WEAR RESISTANT LINER

[75] Inventors: Manfred Gstettner; Bruno Hribernik; Alexander Kohnhauser, all of Kapfenberg, Austria

[73] Assignee: Vereinigte Edelstahlwerke Aktiengesellschaft (VEW), Vienna, Austria

[21] Appl. No.: 561,279

[22] Filed: Dec. 14, 1983

[30] Foreign Application Priority Data

Dec. 23, 1982 [AT] Austria ..... 4679/82

[51] Int. Cl.[4] ..... F41C 21/02; B22F 7/04

[52] U.S. Cl. ..... 42/76.02; 138/143; 228/263.13; 228/263.19; 419/8; 428/558

[58] Field of Search ..... 42/76 A; 428/558, 554, 428/555, 36; 138/140, 143, 145; 419/8; 228/2.5, 263.13, 263.19

[56] References Cited

U.S. PATENT DOCUMENTS

| | | | |
|---|---|---|---|
| 930,927 | 8/1909 | Berkstresser | 42/76.01 X |
| 2,372,202 | 3/1945 | Hensel et al. | 428/558 |
| 2,636,849 | 4/1953 | Brenner | 204/9 X |
| 2,977,666 | 4/1961 | Brace et al. | 42/76 A |
| 3,112,553 | 12/1963 | Safranek | 228/263.13 X |
| 3,261,121 | 7/1966 | Eves | 42/76 A |
| 3,753,704 | 8/1973 | Manilla et al. | 75/208 R |
| 4,016,008 | 4/1977 | Forbes et al. | 138/140 |
| 4,327,154 | 4/1982 | Rossmann | 428/545 |
| 4,426,248 | 1/1984 | Jackson | 427/239 X |

FOREIGN PATENT DOCUMENTS

| | | |
|---|---|---|
| 2504032 | 8/1975 | Fed. Rep. of Germany . |
| 2514565 | 10/1976 | Fed. Rep. of Germany . |
| 2855155 | 6/1979 | Fed. Rep. of Germany . |
| 3114659 | 1/1982 | Fed. Rep. of Germany . |

*Primary Examiner*—Ted L. Parr

*Attorney, Agent, or Firm*—Werner W. Kleeman

[57] ABSTRACT

The weapon barrel comprises a liner and at least one jacket tube. The liner is made of a highly wear-resistant material, like a cobalt or nickel base alloy, and the jacket tube is made of a tough alloy, like steel. In the manufacturing process the liner material is packed into the jacket tube in the form of a powdery material which may be pre-pressed or pre-sintered. The packing is arranged such as to leave a central free space in the jacket tube, and the jacket tube may be surrounded by an encapsulating tube. The jacket tube or the encapsulating tube is closed either before or after evacuation, and the closed tube arrangement is subjected to a combined heat and pressure treatment at temperatures of at least 900° C., but below the melting point of the relevant materials and at pressures of at least 900 bar. The compound body thus obtained is formed with a full-area metallic bond between the liner and the jacket tube. After eventual heat treatment the compound body is further machined and a rifling is worked thereinto as, for example, by forging.

12 Claims, 1 Drawing Sheet

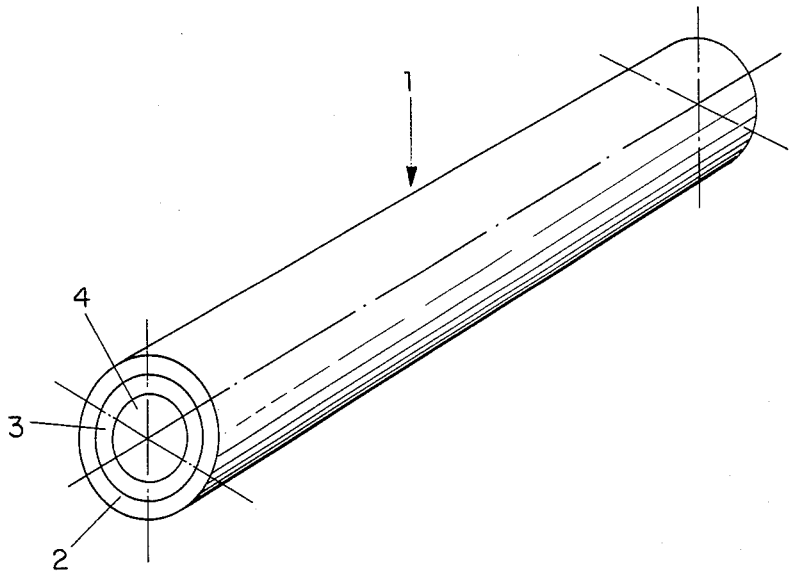
1
4
3
2

WEAPON BARREL WITH METALLORGICALLY BONDED WEAR RESISTANT LINER

BACKGROUND OF THE INVENTION

The present invention relates to a new and improved method of manufacturing a weapon barrel comprising a liner and at least one jacket tube which are formed from different metallic materials.

The present invention also relates to a new and improved weapon barrel comprising a liner and at least one jacket tube which are formed from different metallic materials.

Weapon barrels are subjected to two entirely different stresses or loads. On the one hand, a high pressure is built up in the interior of the barrel due to the explosion of the propellant charge of a projectile and the weapon barrel must be capable of withstanding such pressure. On the other hand, the projectile is driven through the barrel at a high velocity and is caused to spin by means of a rifling in the weapon barrel for stabilizing the projectile trajectory. The interior of the barrel is thus subjected to an extremely abrasive stress or load. The two stresses or loads, however, impose different requirements upon the material forming the weapon barrel. One possibility of satisfying these different requirements is to provide correspondingly large dimensioning of the weapon barrels. However, the weapon mobility is thus impaired and, furthermore, an extremely great amount of material is required.

In a known method of manufacturing a weapon barrel a liner tube is placed in a shrink-fitting arrangement into a jacket tube. In this method it is disadvantageous that there is required a precise working of the internal bore of the jacket tube as well as of the exterior surface of the liner tube. In the event of damage to the internal tube, for example, by cracks or fissures which result from pressure stresses, there can occur a substantial change in the weapon caliber, and, as a result, a destruction of the weapon barrel by a projectile.

It has also become already known to the art to provide a fiber-reinforced layer as a connecting tube between a liner tube made of steel and an exterior or outer tube which is also made of steel. Such constructions have become known for a gun barrel as well as for hand weapons or firearms. When using such a construction a weapon barrel of low weight can be produced; however the operability of such a barrel is very limited due to the thermal sensitivity of the material which is arranged between the two tubes. Particularly, in actual use the thermal stress exerted upon a weapon barrel, and specifically, caused by the temperature of the propellant gases as well as by the abrasive stress exerted upon the barrel by the projectile, can not be subjected to narrowly defined limits.

SUMMARY OF THE INVENTION

Therefore, with the foregoing in mind it is a primary object of the present invention to provide a new and improved method of manufacturing a weapon barrel comprising a liner or liner tube and at least one jacket tube formed from different metallic materials, which permit the production of a particularly light-weight weapon barrel resistant to the different stresses or loads acting thereon during use thereof.

Another important object of the present invention is directed to the provision of a new and improved method of manufacturing weapon barrels comprising a liner or liner tube and at least one jacket tube which are made of different metallic materials and which are suitable for use with larger guns as well as for small arms and hand firearms.

Still a further significant object of the present invention is to devise an improved weapon barrel produced according to the inventive method.

Now in order to implement these and still further objects of the invention, which will become more readily apparent as the description proceeds, the method of the present development is manifested by the features that, into a jacket or encasing tube which, if desired, is arranged within an encapsulating tube and which is made of a tough alloy like, for example, steel, there is placed a packing for forming the liner or liner tube and having a bulk density of at least 60 percent of the density of the compact material and comprising a powdery, highly wear-resistant, specifically wear-resistant at increased temperatures and/or corrosion-resistant material, possibly in a pre-pressed and/or pre-sintered state, and preferably such as to leave a free hollow and particularly central space in the jacket tube, eventually compacting the powdery material, closing the ends of either the jacket tube or the encapsulating tube, evacuating the arrangement either prior to or after closing the ends, compressing the closed tube arrangement, for example, in a protective gas atmosphere and at a temperature of at least 900° C., however, below the melting points of the metallic materials, at a pressure of at least 900 bar in order to form a compound or composite body comprising a full-area metallic bond between the jacket tube and the compacted material, eventually heat-treating the compound body thus obtained, mechanically working the compound body and, eventually, working a rifling thereinto as, for example, by forging.

A weapon barrel produced according to the aforementioned method has the advantage of particularly favorably taking account of the high pressure stresses or loads as well as the abrasive stresses, and in the manufacturing method there is present a particularly advantageous combination of melting and powder metallurgical method steps.

When the central hollow region is left free by means of a filling body, preferably made of a material such as machining or machinable steel which can be readily machine cut, an unnecessary loss of the expensive metal powder can be spared, and at the same time the mechanical working can be accomplished in a particularly easy manner.

In the event that a tube is used in place of the filling body, then the manipulation can be especially simply performed since the weight of the compound or composite body can be maintained particularly low.

In a further development of the method according to the invention the compound body, prior to being mechanically worked to yield a weapon barrel, is subjected to hot forming, particularly forging, including an at least 1.3-fold, in particular an at least two-fold change in shape. A particularly homogeneous structure can thus be achieved for the liner tube component which is powder-metallurgically formed, and simultaneously a longer service-life of the weapon barrel is obtained.

When a tough material like titanium or a titanium alloy is used for the jacket tube, a particularly light-weight weapon barrel can be produced.

For weapon barrels which are to be used in guns or the like having a particularly flat trajectory, a cobalt base alloy is used for the highly wear-resistant material.

In guns in which particularly corrosive propellant charges are used, a nickel base alloy is used as the material for filling the jacket tube.

According to a further feature of the inventive method a jacket tube is used which comprises, at the inner cylindrical surface thereof, a coating made of a bonding agent which comprises nickel or the like.

As alluded to above, the invention is not only concerned with the aforementioned method aspects, but also relates to a novel weapon barrel obtained by the performance thereof. Generally speaking, the inventive weapon barrel comprises a liner and at least one jacket tube which are made of different metallic materials.

To achieve the aforementioned measures the inventive weapon barrel, in its more specific aspects, comprises:

a jacket tube comprising a tough alloy; and a liner formed by a highly wear-resistant powdery material which is full-area metallically bonded to the interior or inner surface of said jacket tube.

DETAILED DESCRIPTION OF THE PREFERRED EMBODIMENTS

The invention will be still further understood and additional objects other than those set forth above, will become apparent when consideration is given to the following detailed description of specific examples thereof. In these examples percents, unless otherwise indicated, are given as percents-by-weight.

EXAMPLE 1

For further processing to form the gun barrel of a machine gun, a compound or composite metal tube member is produced in the following manner:

Into a jacket encasing tube comprising steel of the type X40CrMoV51, the composition of which is 0.38% carbon, 1.1% silicon, 0.38% manganese, 5.20% chromium, 1.30% molybdenum and 1.2% vanadium, the rest being substantially iron, and having the dimensions 46 mm outer diameter, 15 mm wall thickness and 650 mm length, there is centrally inserted a rod of the same length which is made of machining steel. Into the remaining hollow space there is placed a metal powder for forming the liner and consisting of a heat-resistant nickel base alloy comprising 0.12% carbon, 20.0% chromium, 18.1% cobalt, 2.5% titanium, 1.5% aluminum, 1.5% iron, the rest or remainder substantially being nickel. The powder is compacted by evacuating and after the evacuation the ends of the jacket tube are gas-tight closed by welding thereto circular-shaped sheet plates. The tube arrangement is then isostatically hot-pressed at about 1080° C. and at a gas pressure of about 1100 bar for 3 hours. After cooling the central core consisting of machining steel is bored out in its entirety. Thereafter the further mechanical working for producing the rifling and for finishing the barrel are performed.

In further aiding the understanding of the invention, there is given in the following a detailed description of a compound body for producing a weapon barrel and which is obtained when employing the aforedescribed method. Such description makes reference to the annexed single drawing which shows a perspective view of such compound body.

The illustrated compound body 1 is composed of three elements. The outer element 2 constitutes the original jacket encasing tube which is made of X40CrMoV51 steel. A further hollow cylinder constitutes the weapon barrel liner and originally consisted of the nickel base alloy powder. As a result of the isostatically hot-pressing operation, this weapon barrel liner has become metallurgically bonded substantially to the entirety of the interior surface of the outer element 2 or jacket encasing tube. A rod 4 fills the interior space of the outer element 2 or weapon barrel liner. This rod 4 is made of machining steel and is removed during the later steps of the operation for producing the rifling and for finishing the weapon barrel.

EXAMPLE 2

An encapsulating tube having a sheet bottom member which is made of unalloyed structural steel, has an outer diameter of 68 mm, an inner diameter of 62 mm and a length of 800 mm. A jacket or encasing tube is made of an alloy having the following composition (each in percent by weight): carbon 0.33, silicon 0.28, manganese 0.50, chromium 3.0, molybdenum 1.2, vanadium 0.27, the rest being iron. The jacket tube has an outer diameter of 60 mm, an inner diameter of 40 mm and a length of 800 mm. The jacket tube is placed into the encapsulating tube. A cylindrical core made of machining steel and having an outer diameter of 18 mm and a length of 800 mm is centrally inserted into the jacket tube. The intermediate space which forms a hollow cylinder, is filled by a powder for forming the liner or liner tube and comprising a cobalt base alloy having the following composition (each in percent by weight): carbon 0.17, silicon 0.35, manganese 0.65, chromium 28.0, molybdenum 5.6, nickel 0.5 at the maximum, cobalt 66.0, and iron 0.5 at the maximum. A density of 6.5 $gm/cm^3$ is obtained by vibrating. The material is degassed at about 350° C. and an upper cover including a suction port is welded to the encapsulating tube. The tube arrangement is then evacuated and the suction port is closed. The encapsulated body is, then, isostatically hot-pressed in an argon atmosphere at about 1150° C. and at a pressure of about 1000 bar for 3 hours. Thereafter, the compound or composite body is forged on a longitudinal forging machine to yield an outer diameter of about 35 mm, which approximately corresponds to a three-fold change in shape. After forging the compound body is subjected to solution treatment at about 1100° C. for 1 hour and, then, a barrel for a heavy-duty machine gun is manufactured by mechanical machining and cold-hammering or forging a rifling.

EXAMPLE 3

An encapsulating tube including a sheet bottom member made of unalloyed structural steel has an outer diameter of 215 mm, an inner diameter of 210 mm and a length of 900 mm. A hollow cylinder defining the jacket or encasing tube and made of heat-treatable steel has the following composition (each in percent by weight): carbon 0.41, silicon 0.3, manganese 0.7, chromium, 1.1, molybdenum 0.2. The hollow cylinder has an outer diameter of 210 mm, an inner diameter of 160 mm and a length of 900 mm and is placed into the encapsulating tube. A cylindrical rod made of machining steel has an outer diameter of 45 mm and a length of 900 mm and is placed at the center of the jacket tube. The intermediate space forms a hollow cylinder and is filled with a powder of a cobalt base alloy having the following composition (each in percent by weight): carbon 0.17, silicon 0.35, manganese 0.65, chromium 28.0, molybdenum 5.5, nickel 0.5 at the maximum, cobalt 66.0, and iron 0.5 at the maximum. This powder ultimately forms the liner or liner tube. A density of 6.7 gm/cm$^3$ is obtained by vibrating. After degassing at about 340° C. an upper cover including a suction port is welded to the tube arrangement. Thereafter, the tube arrangement is evacuated and isostatically hot-pressed as described in Example 2. The compound body thus obtained is forged to diameters of 105, 35 and 23 mm, respectively, and to a length of 3,500 mm corresponding to a four-fold change in shape using a longitudinal forging machine. Further working is accomplished analogous to Example 2, however, a tensile strength in the range of 900 to 1100 Nm$^2$ is adjusted by tempering the jacket tube. The tube thus obtained has a caliber of 1 inch and was used for a rapid firing cannon.

EXAMPLE 4

An encapsulating or encasing tube is provided with a bottom member. A jacket tube of the type TiA16V4 has an outer diameter of 210 mm, an inner diameter of 160 mm and a length of 900 mm and is placed into the encapsulating tube. Thereafter, a core rod made of machining steel and having a diameter of 45 mm and a length of 900 mm is placed into the jacket tube. The intermediate space is filled with a powder for forming the liner and having the following composition (each in percent by weight): carbon 0.34, chromium 1.2, molybdenum 0.2, aluminum 0.95 and the rest iron. The material is then compacted to a density of 70% of the density of the non-powdery material in the solid state. Thereafter the process is carried out as described with reference to Example 3, and the compound or composite body thus obtained is forged to have a diameter of 105 and 35 mm, respectively, and a length of 3,500 mm, which corresponds to a four-fold change in shape. The compound body is heated at about 940° C. for 1 hour, then oil-cooled and annealed at about 520° C. for 4 hours. After machining the inner surface is nitrided to a depth of 0.3 to 0.4 mm in a manner which is known as such, and therefore, need not be here described in any particular detail.

The covers may also be welded directly to the jacket tube instead of to the encapsulating tube, since no pressure action in radial direction can occur on the powder due to the material thickness of the jacket tube. The core may also be formed by a hollow cylinder which lends itself particularly for larger calibers, and in this case the forging operation may be performed on a mandrel.

There can also be used a jacket tube containing a layer on the interior surface which, for example, may be electrolytically deposited and may comprise nickel or the like. Such coating may function as a bonding agent between the material of the jacket tube and the powder.

In all the illustrative examples as given hereinbefore there occurred a full-area bond between the jacket tube and the liner or liner tube. For example, in the case of the cobalt hard alloy as used in Example 2 the following property improvements can be achieved by the isostatic hot-pressing or, respectively, by isostatically hot-pressing and forging:

| | Melt-metallurgical Alloy | Powder-metallurgical Alloy | Powder-metallurgical Alloy Plus two-fold Change in Shape By Forging |
|---|---|---|---|
| Tensile Strength Rm in N/mm$^2$ | 665 | 1050 | 1080 |
| Yield Strength $R_p$ 0.2 in N/mm$^2$ | 450 | 600 | 700 |
| Fracture contraction Z in % | 8 | 9 | 19 |

While there have been described present preferred embodiments of the invention, it is to be distinctly understood that the invention is not limited thereto, but may be otherwise variously embodied and practiced within the scope of the following claims. ACCORDINGLY,

What we claim is:

1. A weapon barrel comprising a liner and at least one jacket tube, the liner and the at least one jacket tube being made of different metallic materials, said weapon barrel being produced by the method comprising the steps of:

providing an encasing tube defining the jacket tube and having two ends and made of a tough alloy;

placing into said encasing tube a packing of a highly wear-resistant, powdery material for forming the liner;

closing said encasing tube at said ends thereof and evacuating the same;

heating said encasing tube after closing the same to a temperature of at least 900° C., but below the melting points of said encasing tube and said packing and simultaneously subjecting said closed encasing tube to a pressure of at least 900 bar to form a compound body with a substantially full-area metallurgical bond between said encasing tube and the powdery material which has been compressed, and mechanically working said compound body to form said weapon barrel.

2. A weapon barrel comprising a liner and at least one jacket tube, the liner and the at least one jacket tube being made of different metallic materials, said weapon barrel being produced by the method comprising the steps of:

providing an encasing tube defining the jacket tube and having two ends and made of a tough alloy;

placing into said encasing tube a packing of a highly wear-resistant, powdery material for forming the liner;

closing said encasing tube at said ends thereof and evacuating the same;

heating said encasing tube after closing the same to a temperature of at least 900° C., but below the melting points of said encasing tube and said packing and simultaneously subjecting said closed encasing tube to a pressure of at least 900 bar to form a compound body with a substantially full-area metallurgical bond between said encasing tube and the powdery material which has been compressed;

mechanically working said compound body to form said weapon barrel; and said packing being metallurgically bonded to said encasing tube in the presence of a protective gas atmosphere.

3. A weapon barrel comprising a liner and at least one jacket tube, the liner and the at least one jacket tube being made of different metallic materials, said weapon barrel being produced by the method comprising the steps of:

providing an encasing tube defining the jacket tube and having two ends and made of a tough alloy;

placing into said encasing tube a packing of a highly wear-resistant, powdery material for forming the liner;

closing said encasing tube at said ends thereof and evacuating the same;

heating said encasing tube after closing the same to a temperature of at least 900° C., but below the melting points of said encasing tube and said packing and simultaneously subjecting said closed encasing tube to a pressure of at least 900 bar to form a compound body with a substantially full-area metallurgical bond between said encasing tube and the powdery material which has been compressed;

mechanically working said compound body to form said weapon barrel; and said packing being formed from a powdery material having a bulk density measured in mass per unit volume of the powdery material and amounting to at least 60% of the density of said powdery material when in the non-powdery solid state.

4. A weapon barrel comprising a liner and at least one jacket tube, the liner and the at least one jacket tube being made of different metallic materials, said weapon barrel being produced by the method comprising the steps of:

providing an encasing tube defining the jacket tube and having two ends and made of a tough alloy;

placing into said encasing tube a packing of a highly wear-resistant, powdery material for forming the liner;

closing said encasing tube at said ends thereof and evacuating the same;

heating said encasing tube after closing the same to a temperature of at least 900° C., but below the melting points of said encasing tube and said packing and simultaneously subjecting said closed encasing tube to a pressure of at least 900 bar to form a compound body with a substantially full-area metallurgical bond between said encasing tube and the powdery material which has been compressed;

mechanically working said compound body to form said weapon barrel;

said packing being formed from a powdery material having a bulk density measured in mass per unit volume of the powdery material and amounting to at least 60% of the density of said powdery material when in the non-powdery solid state; and said powdery material for forming said packing being pre-pressed.

5. A weapon barrel comprising a liner and at least one jacket tube, the liner and the at least one jacket tube being made of different metallic materials, said weapon barrel being produced by the method comprising the steps of:

providing an encasing tube defining the jacket tube and having two ends and made of a tough alloy;

placing into said encasing tube a packing of a highly wear-resistant, powdery material for forming the liner;

closing said encasing tube at said ends thereof and evacuating the same;

heating said encasing tube after closing the same to a temperature of at least 900° C., but below the melting points of said encasing tube and said packing and simultaneously subjecting said closed encasing tube to a pressure of at least 900 bar to form a compound body with a substantially full-area metallurgical bond between said encasing tube and the powdery material which has been compressed;

mechanically working said compound body to form said weapon barrel;

said packing being formed from a powdery material having a bulk density measured in mass per unit volume of the powdery material and amounting to at least 60% of the density of said powdery material when in the non-powdery solid state; and said powdery material for forming said packing being pre-sintered.

6. A weapon barrel comprising a liner and at least one jacket tube, the liner and the at least one jacket tube being made of different metallic materials, said weapon barrel being produced by the method comprising the steps of:

providing an encasing tube defining the jacket tube and having two ends and made of a tough alloy;

placing into said encasing tube a packing of a highly wear-resistant powdery material for forming the liner;

closing said encasing tube at said ends thereof and evacuating the same;

heating said encasing tube after closing the same to a temperature of at least 900° C., but below the melting points of said encasing tube and said packing and simultaneously subjecting said closed encasing tube to a pressure of at least 900 bar to form a compound body with a substantially full-area metallurgical bond between said encasing tube and the powdery material which has been compressed;

mechanically working said compound body to form said weapon barrel;

said packing being formed from a powdery material having a bulk density measured in mass per unit volume of the powdery material and amounting to at least 60% of the density of said powdery material when in the non-powdery solid state; and said powdery material for forming said packing being pre-pressed and pre-sintered.

7. A weapon barrel comprising a liner and at least one jacket tube, the liner and the at least one jacket tube being made of different metallic materials, said weapon barrel being produced by the method comprising the steps of:

providing an encasing tube defining the jacket tube and having two ends and made of a tough alloy;

placing into said encasing tube a packing of a highly wear-resistant, powdery material for forming the liner;

closing said encasing tube at said ends thereof and evacuating the same;

heating said encasing tube after closing the same to a temperature of at least 900° C., but below the melting points of said encasing tube and said packing and simultaneously subjecting said closed encasing tube to a pressure of at least 900 bar to form a compound body with a substantially full-area metallurgical bond between said encasing tube and the powdery material which has been compressed;

mechanically working said compound body to form said weapon barrel; and said packing and said at least one jacket tube forming a compound body subjected to hot working.

8. A weapon barrel comprising a liner and at least one jacket tube, the liner and the at least one jacket tube being made of a different metallic materials, said weapon barrel being produced by the method comprising the steps of:

providing an encasing tube defining the jacket tube and having two ends and made of a tough alloy;

placing into said encasing tube a packing of a highly wear-resistant, powdery material for forming the liner;

closing said encasing tube at said ends thereof and evacuating the same;

heating said encasing tube after closing the same to a temperature of at least 900° C., but below the melting points of said encasing tube and said packing and simultaneously subjecting said closed encasing tube to a pressure of at least 900 bar to form a compound body with a substantially full-area metallurgical bond between said encasing tube and the powdery material which has been compressed;

mechanically working said compound body to form said weapon barrel;

said packing and said at least one jacket tube forming a compound body subjected to hot working; and said packing and said at least one jacket tube forming a compound body subjected to forging.

9. A weapon barrel comprising a liner and at least one jacket tube, the liner and the at least one jacket tube being made of different metallic materials, said weapon barrel being produced by the method comprising the steps of:

providing an encasing tube defining the jacket tube and having two ends and made of a tough alloy;

placing into said encasing tube a packing of a highly wear-resistant, powdery material for forming the liner;

closing said encasing tube at said ends thereof and evacuating the same;

heating said encasing tube after closing the same to a temperature of at least 900° C., but below the melting points of said encasing tube and said packing and simultaneously subjecting said closed encasing tube to a pressure of at least 900 bar to form a compound body with a substantially full-area metallurgical bond between said encasing tube and the powdery material which has been compressed;

mechanically working said compound body to form said weapon barrel;

said packing and said at least one jacket tube forming a compound body subjected to hot working; and said packing and said at least one jacket tube forming a compound body subjected to hot working to result in an at least 1.3-fold change in shape.

10. A weapon barrel comprising a liner and at least one jacket tube, the liner and the at least one jacket tube being made of different metallic materials, said weapon barrel being produced by the method comprising the steps of:

providing an encasing tube defining the jacket tube and having two ends and made of a tough alloy;

placing into said encasing tube a packing of a highly wear-resistant, powdery material for forming the liner;

closing said encasing tube at said ends thereof and evacuating the same;

heating said encasing tube after closing the same to a temperature of at least 900° C., but below the melting points of said encasing tube and said packing and simultaneously subjecting said closed encasing tube to a pressure of at least 900 bar to form a compound body with a substantially full-area metallurgical bond between said encasing tube and the powdery material which has been compressed;

mechanically working said compound body to form said weapon barrel;

said packing and said at least one jacket tube forming a compound body subjected to hot working; and said packing and said at least one jacket tube forming a compound body subjected to hot working to result in an at least 2-fold change in shape.

11. A weapon barrel comprising a liner and at least one jacket tube, the liner and the at least one jacket tube being made of different metallic materials, said weapon barrel being produced by the method comprising the steps of:

providing an encasing tube defining the jacket tube and having two ends and made of a tough alloy;

placing into said encasing tube a packing of a highly wear-resistant, powdery material for forming the liner;

closing said encasing tube at said ends thereof and evacuating the same;

heating said encasing tube after closing the same to a temperature of at least 900° C., but below the melting points of said encasing tube and said packing and simultaneously subjecting said closed encasing tube to a pressure of at least 900 bar to form a compound body with a substantially full-area metallurgical bond between said encasing tube and the powdery material which has been compressed;

mechanically working said compound body to form said weapon barrel;

said packing and said at least one jacket tube forming a compound body subjected to hot working; and a rifling machined into said compound body.

12. A weapon barrel comprising a liner and at least one jacket tube, the liner and the at least one jacket tube being made of different metallic materials, said weapon barrel being produced by the method comprising the steps of:

providing an encasing tube defining the jacket tube and having two ends and made of a tough alloy;

placing into said encasing tube as packing of a highly wear-resistant, powdery material for forming the liner;

closing said encasing tube at said ends thereof and evacuating the same;

heating said encasing tube after closing the same to a temperature of at least 900° C., but below the melting points of said encasing tube and said packing and simultaneously subjecting said closed encasing tube to a pressure of at least 900 bar to form a compound body with a substantially full-area metallurgical bond between said encasing tube and the powdery material which has been compressed;

mechanically working said compound body to form said weapon barrel;

said packing and said at least one jacket tube forming a compound body subjected to hot working;

a rifling machined into said compound body; and said rifling being machined into said compound body by forging.

* * * * *